United States Patent [19]

Dittmann et al.

[11] 3,990,143

[45] Nov. 9, 1976

[54] METHOD FOR TERMINATING AN ELECTRICAL WIRE IN AN OPEN BARREL TERMINAL

[75] Inventors: Larry Eugene Dittmann, Harrisburg; Timothy Allen Lemke, Dillsburg, both of Pa.

[73] Assignee: AMP Incorporated, Harrisburg, Pa.

[22] Filed: June 17, 1975

[21] Appl. No.: 587,587

Related U.S. Application Data

[62] Division of Ser. No. 481,590, June 21, 1974, Pat. No. 3,892,459.

[52] U.S. Cl. ..... 29/628; 29/630 A; 339/95 R; 339/276 T

[51] Int. Cl.² ..... H01R 43/00

[58] Field of Search ..... 339/95, 97, 98, 99, 339/223, 276; 174/84 C, 94 R, 90; 29/628, 629, 630 R, 630 A, 203 D, 203 DT, 203 DS; 72/404, 405, 324, 338

[56] References Cited

UNITED STATES PATENTS

| | | | |
|---|---|---|---|
| 2,535,013 | 12/1950 | Freedom | 339/276 T |
| 2,685,076 | 7/1954 | Hoffman | 339/276 T |
| 2,945,206 | 7/1960 | Hammell | 29/630 A X |
| 3,076,255 | 2/1963 | Woolley | 29/630 A |
| 3,496,520 | 2/1970 | Reynolds | 339/95 R |

*Primary Examiner*—James R. Duzan
*Attorney, Agent, or Firm*—Allan B. Osborne

[57] ABSTRACT

The invention relates to a terminal and a method for terminating an electrical wire therein. The terminal employs a wire barrel having a asymmetrical pattern of cavities into which the wire is extruded. The method provides optimum electrical contact through high level deformation and maximum tensile strength through low level deformation.

5 Claims, 2 Drawing Figures

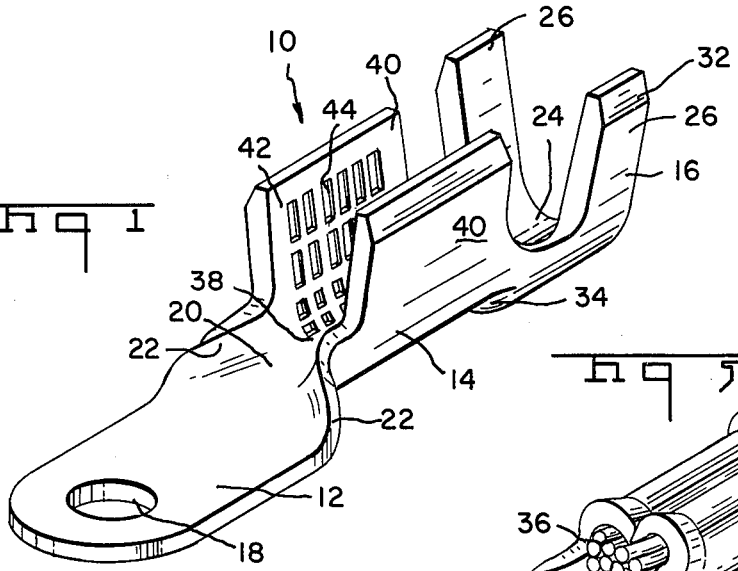
Fig 1
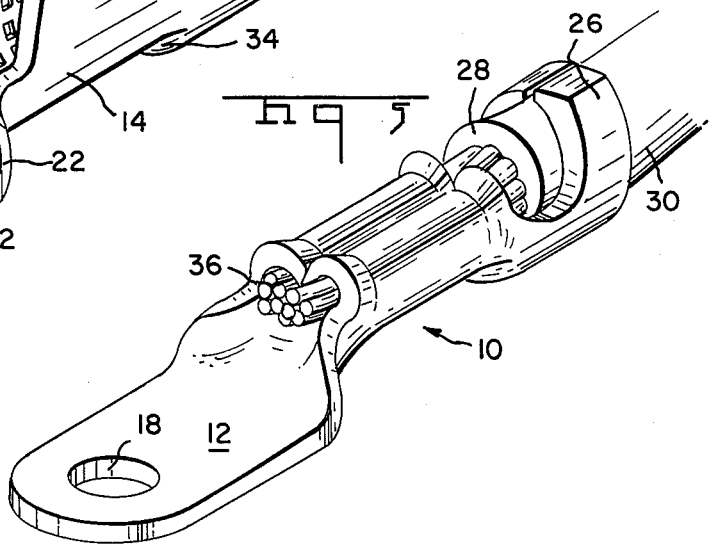
Fig 5
Fig 3
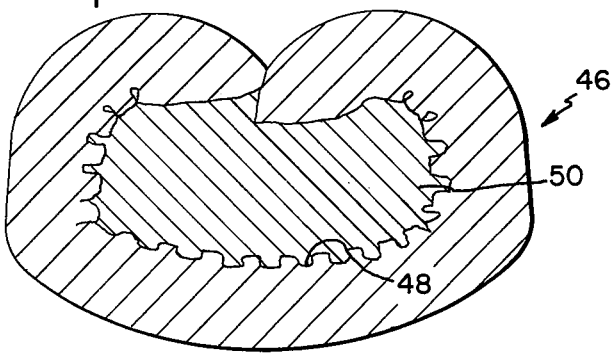
PRIOR ART
Fig 2
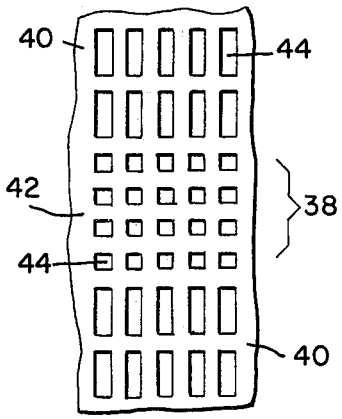
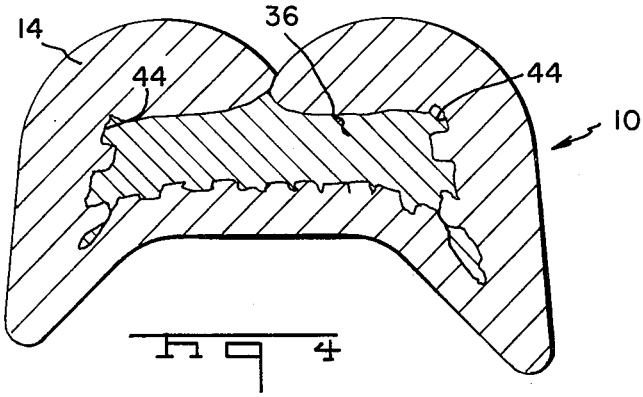
Fig 4

METHOD FOR TERMINATING AN ELECTRICAL WIRE IN AN OPEN BARREL TERMINAL

This is a division of application Ser. No. 481,590, filed June 21, 1974 and now U.S. Pat. No. 3,892,459.

BACKGROUND OF THE INVENTION

The use of multi-stranded aluminum wire has been retarded because of the problems of reliably attaching the wire to a terminal at a reasonable cost. Further, the use of aluminum wire has been impeded by failures of prior art terminals wherein the failure has been catastrophic; i.e., sudden, rather than a gradual deterioration such as experienced with conventional copper conductors and brass, copper or other like terminals.

One well known problem with aluminum wire is its ability; i.e., the several individual strands to move or creep under temperature cycling common to all electrical connections. This phenomenon had for years prevented the use of conventional crimping technique on aluminum wire.

Terminals which are attached to electrical conductors through crimping techniques are either open or closed barrel.

The open barrel terminal is one having a U-shape; i.e., a floor bounded on two sides by vertical sidewalls. In crimping, the wire is laid on the floor and the walls are folded or otherwise wrapped around the wire into an encompassing relation.

A closed barrel terminal is one having a hollow cylinder in which the conductor is received. The cylinder or portion thereof is collapsed down onto the wire squeezing such thereinbetween.

With respect to terminating multi-stranded aluminum wire, workers in the field have been successful in crimping such in closed barrel terminals wherein perforated liners are employed. These liners, placed in the hollow cylinder and around the wire, serve to break up aluminum oxides and further to cause the strands to be squeezed into the perforations. These actions result in good electrical and mechanical terminations. One such example of a closed barrel aluminum termination is disclosed in U.S. application Ser. No. 346,530, filed on Mar. 29, 1973, now abandoned, the disclosure being incorporated herein by reference.

Contra, aluminum termination in open barrel terminals have not met with a high degree of acceptability. One reason therefore relates to the aforementioned creep phenomenon. Another problem, common to both type of terminals but more conducive in open barrel terminals, is corrosion, particularly galvanic corrosion.

Accordingly it is an object of the present invention to provide a terminal and a method of terminating an electrical wire therein which will cause inter-strand bonding so that the individual strands cannot move but as a unit and that movement thereof is prevented by extruding wire into cavities located on the sidewalls of the terminal.

BRIEF DESCRIPTION OF THE DRAWINGS

FIG. 1 is a perspective view of an open barreled terminal constructed in accordance with the principles of the present invention;

FIG. 2 is a view of the asymmetrical pattern of cavities constructed in accordance with the principles of the present invention;

FIG. 3 is a cross-sectional view taken normal to the axis of a prior art terminal;

FIG. 4 is a cross-sectional view taken normal to the axis of the terminal of FIG. 5;

FIG. 5 is the terminal of FIG. 1 after being crimped onto a multi-stranded wire in accordance with the principles of the present invention.

DESCRIPTION OF THE PREFERRED EMBODIMENT

Figure 6:
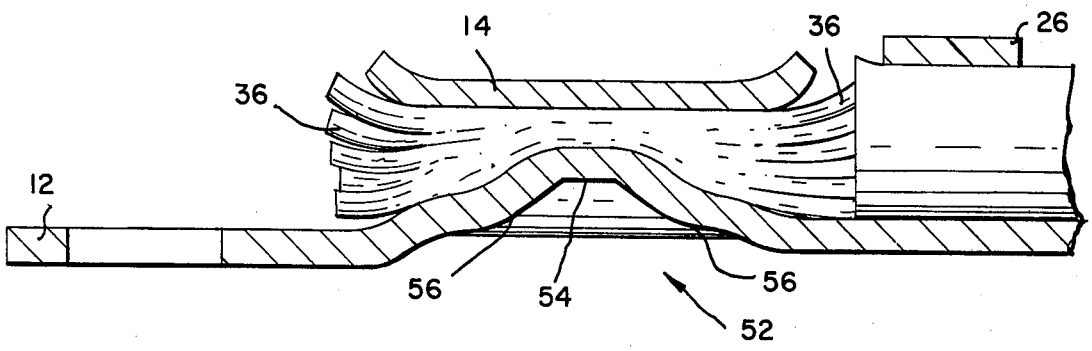
FIG. 6 is a longitudinal cross-sectional view of the terminal of FIG. 3.

Referring now to the drawings wherein like reference numerals represent corresponding parts in all figures, there is shown in FIG. 1 an open barrel terminal 10 constructed in accordance with the present invention. The three prominent elements of terminal 10 are, from front to rear, the tongue 12, wire barrel 14 and insulation barrel 16. These elements in the preferred embodiment shown are integral, the terminal being stamped and formed from a single coplanar sheet of conductive material. However, the novelty resides in the wire barrel 14 and in the method of crimping it around a wire. Thus it is to be understood that the presence of tongue 12 and insulation barrel 16 is not to be taken as limiting the invention to a terminal possessing all three elements.

Connecting means 12 is the dynamic contact interface of terminal 10 in that it provides a movable; i.e., non-permanent point of electrical contact between the terminated conducting wire and an electrical junction such as a motor, control box, generator or the like (none of which are shown in the drawings). The configuration of connecting means 12 can take many different shapes as is well known in the industry. The particular one shown here; i.e., a "ring tongue", is designed generally to receive a threaded post (not shown) through hole 18. A nut (not shown) threaded down the post secures terminal 10 to the post mounting.

The transition or connecting strap 20 between the connecting means 12 and wire barrel 14 may be abrupt or the edges 22 may be curled as shown to add structural strength to the forwardly extending connecting means 12. This structural feature is referred to as a "transitional curl".

Insulation barrel 16 consists of a floor member 24 bounded on either side by upright sidewalls 26. The dimensions of barrel 16 are such that the sidewalls may be crimped around the outer insulation jacket 28 of cable 30 as shown in FIG. 5. The beveled surfaces 32 on the top of each sidewall 26 facilitate the crimping action as is well known in the art.

The insulation barrel 16 is displaced downwardly with respect to wire barrel 14. This displacement, generally indicated by reference numeral 34, accommodates the outer diameter of cable 30 so that the multi-stranded wire 36 (FIG. 5) will lay in wire barrel 14 without being bent downwardly as the case would be otherwise.

wire barrel 14 consists of a floor 38 and opposing sidewalls 40. As with insulation barrel 16 the sidewalls are beveled to facilitate crimping.

The floor and inner surfaces of sidewalls 40; i.e., the inner surface 42 of wire barrel 14, contains a plurality of cavities 44. Although these cavities are both rectangular and square, the precise geometry is not critical. However, the general pattern is; i.e., note that the inside cavities; i.e., those on floor 38 and on the flanks of the sidewalls, are smaller length and breadthwise, than those cavities higher up on the sidewalls 40 which are elongated. As is well known in the art, smaller cavities are desirable in terminating wire because, for a given inner surface area, the smaller cavities will provide a larger contact area between the terminal and wire terminated therein. Prior art terminals, in attempting to gain all the contact area possible, punched in small, uniform size cavities throughout the inner surface of the wire barrel. However, it has been discovered that the use of small cavities on the sidewalls are self-defeating. As the sidewalls are crimped, the inner surface area decreases and the cavities in the fold over region close off before the wire can be squeezed thereinto. FIG. 3 is a drawing of a prior art terminal. The terminal herein designated by reference numeral 46, contained a plurality of cavities 48 which were uniform and small in size, conforming to prior art practice. As seen in the drawing, as the wire barrel of terminal 46 was crimped about wire 50, the cavities in the fold-over region; i.e., upper portions of the sidewalls, pinched shut before the wire could be compressed thereinto. In contrast, FIG. 4 is a drawing of a terminal 10 having the cavity pattern shown in FIG. 2. It is clear that the elongated cavities remained open to receive wire 36. Both FIGS. 3 and 4 are drawings from actual photographs of terminals sectioned normal to the longitudinal axis and across the wire barrel.

FIGS. 4, 5 and 6 illustrate the method and result of crimping wire barrel 14 around multi-stranded wire 36 as developed by the present invention.

Two operations are performed simultaneously in terminating wire 36. After the bared wire is laid in the wire barrel the sidewalls 40 are folded in on the wire by conventional crimping techniques. FIG. 4 and 5 illustrates the shape imparted to the top of terminal 10 thereby. At the same time, a die (not shown) strikes the bottom of the wire barrel sharply and substantially deforms it as shown in FIGS. 4 and 6, the deformed area being generally designated by reference numeral 52. The shape of the die is such as to provide two distinct levels of deformation as clearly shown in FIG. 6 which is a longitudinal cross-section. The high level deformation is designated by reference numeral 54 and the low level deformation is designated by reference numeral 56. FIG. 4 is a normal cross-sectional view across high deformation level 54. The high level deformation provides the electrical relation and the low level deformation provides the mechanical relation between the wire and wire barrel. There are beneficial and unexpected effects resulting from the high deformation. With reference primarily to FIG. 6, an elongation or stretching of wire 36 occurs. The stretching causes the fracturing of brittle oxide film which generally is present on the strand's surfaces. The pressure exerted on the wire from the deformation causes clean metal to be extruded through the induced fissures in the oxide film. The clean metal is bonded or cold welded with other extruded clean metal by the pressure of deformation.

The maximum elongation obviously occurs along the wire's longitudinal axis. Further, most of the bonding occurs between the inner strands of wire 36 with little or no bonding occurring at the interface of the terminal and wire. However, mechanical and electrical integrity is achieved primarily at the interface with the extruding into and filling of cavities 44 by the wire.

With respect to the low level deformation 56, the amount of deformation required to achieve maximum tensile strength is equal to about a 30 percent reduction in overall cross-sectional area. In addition to the amount of deformation, tensile strength is enhanced by subjecting a greater area along the axial plane to the low level deformation. As FIG. 6 shows, low level deformation 56 is provided on either axial end of the high level deformation.

With respect to high level deformation 54, the amount of deformation required to achieve optimum electrical performance is equal to about a 60 percent reduction in the total cross-sectional area occupied by a non-deformed wire barrel and wire; provided, that the ratio of 2 to 1 exists between the cross-sectional area of the wire barrel and the cross-sectional area of the wire. A 60 percent overall reduction results in reducing the wire by a factor of about 80 percent which is required to create inter-strand bonding.

The method used to arrive at the aforementioned 2 to 1 ratio is simple and straight forward. Knowing the circular cross-sectional area of a given wire, the width (W) and thickness (T) of the material to be formed into terminal 10 is computated by solving these two simultaneous equations:

$$W = \pi\,[1.3\,(Dw) + T] \text{ and}$$

$$T = \frac{2(CSA)w}{W}$$

where:

$Dw$ = wire diameter $(CSA)w$ = cross-sectional area of the wire

The 1.3 is a multiplier to arrive at the average diameter of the terminal which, as is well known, must be large enough to permit wrapping the terminal sidewalls around the wire.

Although the die used to deform terminal 10 is not shown, its shape can be ascertained from FIGS. 4 and 6. Note that the depression is generally rectangular with the edges and corners rounded to prevent stress-cracking of the terminal during deformation. Further, although not shown, a roughened die has been found to give better results in deforming the terminal than one having a smooth or polished face.

Further, with respect to the concept of deforming the wire barrel 14 of terminal 10 with a roughened die, experimental data indicates that a roughness of 175 micro-inches gives very good results and is preferred. However, satisfactory results have been obtained with dies having a roughness factor ranging from about 32 to about 400 micro-inches. The method used in roughening the die faces is sand blasting with ground shot.

The purpose in using a roughened die face is to create a high degree of friction between the die and wire barrel surface, particularly along what becomes the sidewalls of the deformed area. By creating such friction, the thickness of the wall of the wire barrel being deformed remains uniform or nearly so. By maintaining a uniform wall thickness, it acts as an extension of the die; i.e., very little energy is lost in thinning the walls along the sides of the die. More energy then is transferred to the wire itself. Furthermore, more wire barrel material is moved into the wire area without approaching the stress-cracking level in the material. As workers in the field can appreciate, the more material moved inwardly against the wire, the more the wire will be extruded and more clean metal will result.

As is well known in the art, die faces must be flat or round to push the wire barrel material rather than to pierce it. In determining optimum width of a square die face, tests were conducted. It was found that variations in the amount of wire elongation occurred with die faces of various widths. Through additional testing and studies it was determined that a square die face having a width equal to the thickness of the wire barrel wall provided the maximum elongation in the center strands of the wires. Maximum elongation of course means more fresh metal exposed for bonding. Widths in excess of two thicknesses did not improve the performance while widths between one and two thicknesses were inconclusive to establish a more preferred width other than one thickness. Widths less than one thickness showed definite deterioration in performance.

It has been observed that the pattern of wire extrusion from the wire barrel upon high level deformation is parabolic in a plane parallel to the longitudinal axis with the center strands being axially extruded the furthest. As noted above, as the wire barrel is being deformed inwardly, the cavities are being filled by lateral extrusion of the outermost strands of the wire. Thus, longitudinal elongation is retarded as far as those strands are concerned.

In conclusion, the present invention provides a terminal and a method for terminating wire therein which results in a superior electrical and mechanical connection. More importantly, the terminal and method allows the satisfactory termination of stranded aluminum wire.

The foregoing detailed description has been given for clearness of understanding only, and no unnecessary limitations should be understood therefrom, as some modifications will be obvious to those skilled in the art.

What is claimed is:

1. A method of terminating a wire to a wire barrel of the type having vertical sidewalls, said method comprising the steps of:

a. providing the inner surface of the wire barrel with a plurality of cavities with the outermost cavities being longer in one dimension than the intermost cavities;

b. placing a bared wire in the wire barrel; and c. mechanically deforming the sidewalls in around the wire with at least a portion of each outermost cavity remaining open whereby some of the wire is deformed thereinto.

2. A method of terminating a multi-stranded wire to a U-shaped wire barrel comprising the steps of:

a. placing a bared end of the wire in the wire barrel;

b. crimping the sidewalls of the wire barrel into encompassing engagement with the wire;

c. providing a die having a generally flat face and rounded edges;

d. roughening the die face to a roughness of from about 32 to about 400 microinches; and e. deforming the wire barrel and enclosed wire so that the cross-sectional area of the wire is reduced by a factor of about 80 percent so that cold welding occurs between the strands of wire.

3. The method of claim 2 further including the step of providing a plurality of cavities on the inner surface of the wire barrel.

4. The method of claim 3 wherein the step of providing a plurality of cavities includes providing cavities of larger size on the upper portions of the sidewalls than those cavities on the lower portion of the sidewalls and floor of the wire barrel.

5. The method of claim 2 wherein the flat face of the die has a width equal to about the thickness of the wire barrel wall.

* * * * *